United States Patent [19]

Kamis

[11] Patent Number: 4,665,281

[45] Date of Patent: May 12, 1987

[54] FLEXIBLE TUBING CABLE SYSTEM

[76] Inventor: Anthony G. Kamis, 9841 Kings Canyon Dr., Huntington Beach, Calif. 92646

[21] Appl. No.: 710,626

[22] Filed: Mar. 11, 1985

[51] Int. Cl.[4] ..... H01B 7/20

[52] U.S. Cl. ..... 174/102 R; 174/102 P; 174/118; 174/120 R; 174/120 AR; 174/120 SR

[58] Field of Search ..... 174/102 R, 102 P, 110 N, 174/110 SR, 110 AR, 118, 120 AR, 120 SR, 120 R, 121 AR, 121 SR, 121 R

[56] References Cited

U.S. PATENT DOCUMENTS

| | | | |
|---|---|---|---|
| 2,074,777 | 3/1937 | Coupier | 174/105 R |
| 2,186,441 | 1/1940 | Youmans | 174/102 R X |
| 2,312,506 | 3/1943 | Tomlinson et al. | 174/106 R |
| 2,800,524 | 7/1957 | Van Lear | 174/118 |
| 3,205,296 | 9/1965 | Davis et al. | 174/118 |
| 3,297,818 | 1/1967 | McCleery | 174/118 |
| 3,789,130 | 1/1974 | Parker | 174/118 X |
| 4,284,841 | 8/1981 | Tijundis et al. | 174/110 N X |
| 4,515,993 | 5/1985 | MacKenzie | 174/120 SR X |

FOREIGN PATENT DOCUMENTS

| | | | |
|---|---|---|---|
| 61685 | 5/1979 | Japan | 174/120 R |
| 688185 | 2/1953 | United Kingdom | 174/102 R |

*Primary Examiner*—Morris H. Nimmo
*Attorney, Agent, or Firm*—Edward E. Roberts

[57] ABSTRACT

A flexible tubing cable assembly having an outer sheath of flexible thin wall metal tubing with one or more conductors therein, each of the conductors having a first layer of a first dielectric and a second layer of a second dielectric, with a third dielectric material filling the space between the one or more conductors and the interior of the tubing. In one of several embodiments, the first dielectric is a polyimide film; the second dielectric is a layer of ethylene propylene compound; and the third dielectric is a magnesium oxide insulation. In another embodiment, the first dielectric is a polyimide; the second dielectric is fiberglass; and the third dielectric is a synthetic rubber. The tubing, in cross-section, may be circular or ovate. In addition, the tubing may be of either high tensile strength or low tensile strength, depending upon the weight supported, for instance, if a submersible pump is supported, high tensile strength tubing is used.

12 Claims, 7 Drawing Figures

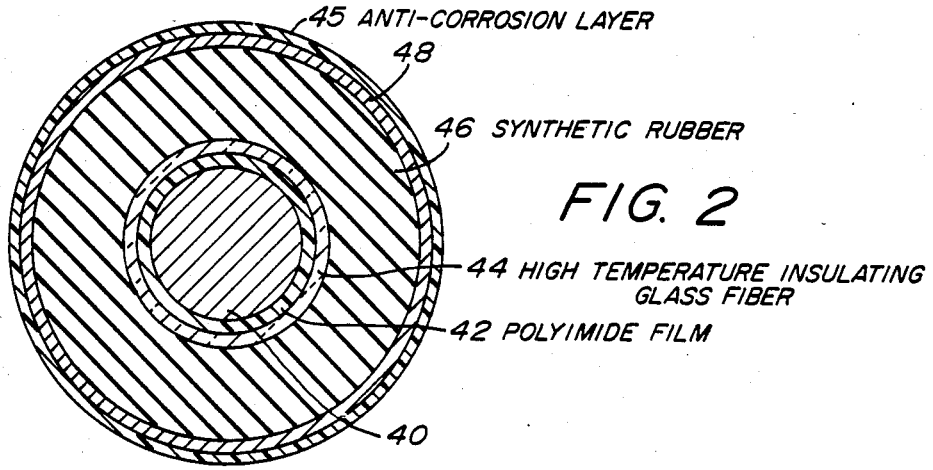
FIG. 2
FIG. 3
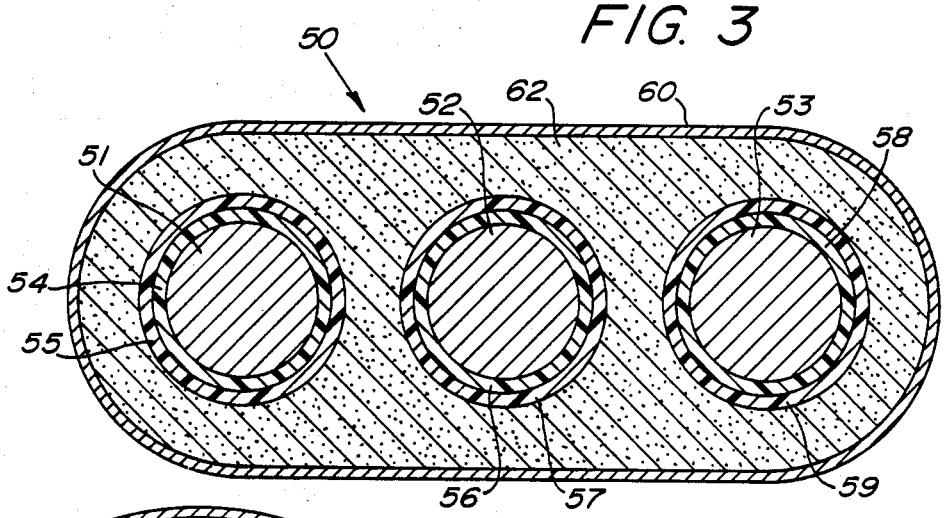
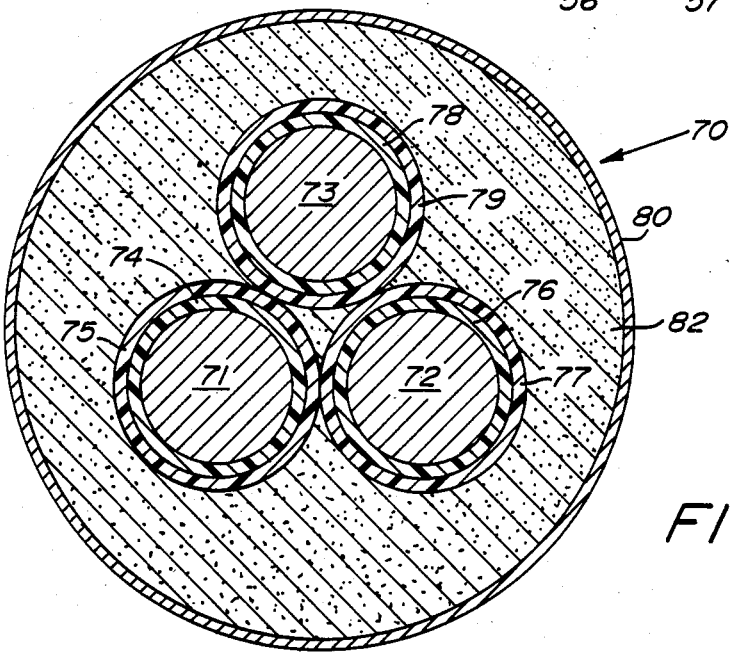
FIG. 4

FLEXIBLE TUBING CABLE SYSTEM

BACKGROUND OF THE INVENTION

The background of the invention will be discussed in two parts.

Field of the Invention

This invention relates to high temperature flexible tubing cable systems, and more particularly to a flexible tubing cable system for use in application requiring submersible pumps and the like.

Description of the Prior Art

In applications requiring submersible pumps, such as in oil well or water pumping applications, a cable assembly is utilized to provide electrical conductors for the motor apparatus, and some means such as a supporting cable is used to support the weitht of the pump and electrical cable during the lowering and sometimes raising of the pump assembly. In such arrangements, the supporting cable must have sufficient strength to support the weight of the pump and the weight of the electrical conductor, which obviously increases as the depth of the pump increases, while simultaneously the supporting cable must be configured and dimensioned to avoid strain on the electrical cables.

In prior art systems, the standard submersible pumping unit consists of a pump, motor protector, and a cable which is run on a production string utilizing a pulling rig. A galvanized cable is lowered alongside the production tubig and banded around and to the tubing with cable bands approximately every fifteen feet for the total pumping depth.

Workover units are known in the art which are used to inject and retrieve a continuous string of tubing into a well for use in conjunction with various fluids which are to be inserted into and/or retrieved from the well. This device permits a continuous string of tubing to be inserted into a well which is far superior to the previously used technique of inserting long individual sections of pipe or tubing.

In such below ground applications, the environment is hostile to the cables, both the supporting cable and the electrical cables, that is, hostile in the sense that the cables are subject to abrasion and exposure to deleterious chemical substances. Also, due to the confinement in a relatively small diameter tube or the like, the flow of electricity through the electrical cables generates heat which is not readily dissipated, and therefore, the assembly must withstand the generated heat, oftentimes in excess of 400 degrees F.

Various cable configurations with a metallic outer cover or sheathing have been devised for various puposes. A "Concentric Cable with Mineral Insulation" is shown and described in U.S. Pat. No. 2,074,777, isssued Mar. 23, 1937, to Coupier, such cable including a centrally disposed metallic conductor, with a concentric tubular conductor, and a concentric outer metallic covering, with the spaces therebetween filled with mineral insulation.

Another cable assembly is shown and described in U.S. Pat. No. 2,312,506, issued Mar. 2, 1943, to Tomlinson, et al, entitled "Electric Cable or Other Insulated Conductor", the cable including a two ply tubular outer metallic covering, with one or more conductors positioned within the tubular opening, the inner ply being formed as a copper sheath, with the outer covering being an alloy for providing heat and/or corrosion resitance. In cable structures such as this, and the cable shown in the Coupier patent, after introduction of the dielectric material into the annular spaces, the cable is subjected to additional treatment such as annealing and drawing to fix the insulation in place.

U.S. Pat. No. 2,351,056, entitled "Electric Conductor", issued June 13, 1944 to Lepetit, shows and describes another concentric cable with a metallic sheath using powdered calcium oxide and magnesium as the insulation media.

Another "Electric Cable" is shown and described in U.S. Pat. No. 2,800,524, issued July 23, 1957 to Van Lear, the cable being heat resistant and including a pair of stranded conductors, a strand sealing compound, a dielectric wrapper, and successive outer covers including an inner metallic electric shield and an outer sheath.

A shielded conductor is shown and described in U.S. Pat. No. 3,205,296, issued Sept. 7, 1965 to Davis, et al, for "Insulated Metallic Sheathed Conductor Employing at Least One Pair of Twisted Signal Carrying Wires", The twisted pair being encased in a dielectric media of alumina, magnesia or equivalent, and an outer covering of stainless steel, or equivalent.

U.S. Pat. No. 3,297,818, isssued Jan. 10, 1967 to McCleery for "Mineral Insulated Electric Cables", the cable being a thermocouple cable intended for use at high temperatures and having conductor pairs of high-nickel alloys.

U.S. Pat. No. 3,789,130, issued Jan. 29, 1974 to Parker for "Tamper Proof Electrical Cables", shows a mineral insulated cable for connection to an alarm circuit for actuation upon intentional damage to a cable assembly in which the mineral insulated cable is embedded.

It is an object of the present invention to provide a new and improved metallic sheathed cable assembly.

It is another object of the present invention to provide a new and improved flexible tubing cable assembly for use with submersible pumps or the like.

It is a further object of the present invention to provide a new and improved flexible tubing cable system having high temperature resistance with an outer metallic covering with high tensile strength, the outer covering providing resistance to deleterious substances.

SUMMARY OF THE INVENTION

The foregoing and other objects of the invention are accomplished by providing a high temperature flexible tubing cable assembly having an outer sheath of flexible thin wall metal tubing with one or more conductors therein, each of the conductors having a first layer of a first dielectric and a second layer of a second dielectric, with a third dielectric material filling the space between the one or more conductors and the interior of the tubing. In one embodiment, the first dielectric is a polyimide film, such as a Kapton layer; the second dielectric is a layer of ethylene propylene compound; and the third dielectric is a magnesium oxide insulation. In another embodiment, the first dielectric is a polyimide; the second dielectric is an insulating glass fiber material; and the third dielectric is a synthetic rubber. The tubing, in cross-section, may be circular or ovate.

Other objects, features and advantages of the invention will become apparent from a reading of the specification, when taken in conjunction with the drawings, in which like reference numerals refer to like elements in the several views.

BRIEF DESCRIPTION OF THE DRAWINGS

FIG. 2 is an enlarged cross-sectional view taken along the line 2—2 of FIG. 1, of the flexible tubing cable used in the submersible pump system shown in FIG. 1;

FIG. 3 is a cross-sectional view of an alternate embodiment of a flexible tubing cable system with multiple conductors for use in the system of FIG. 1; and FIG. 4 is a cross-sectional view of still another alternate embodiment of a flexible tubing cable system with multiple conductors for use in the system of FIG. 1.

DESCRIPTION OF THE PREFERRED EMBODIMENT

Figure 1:
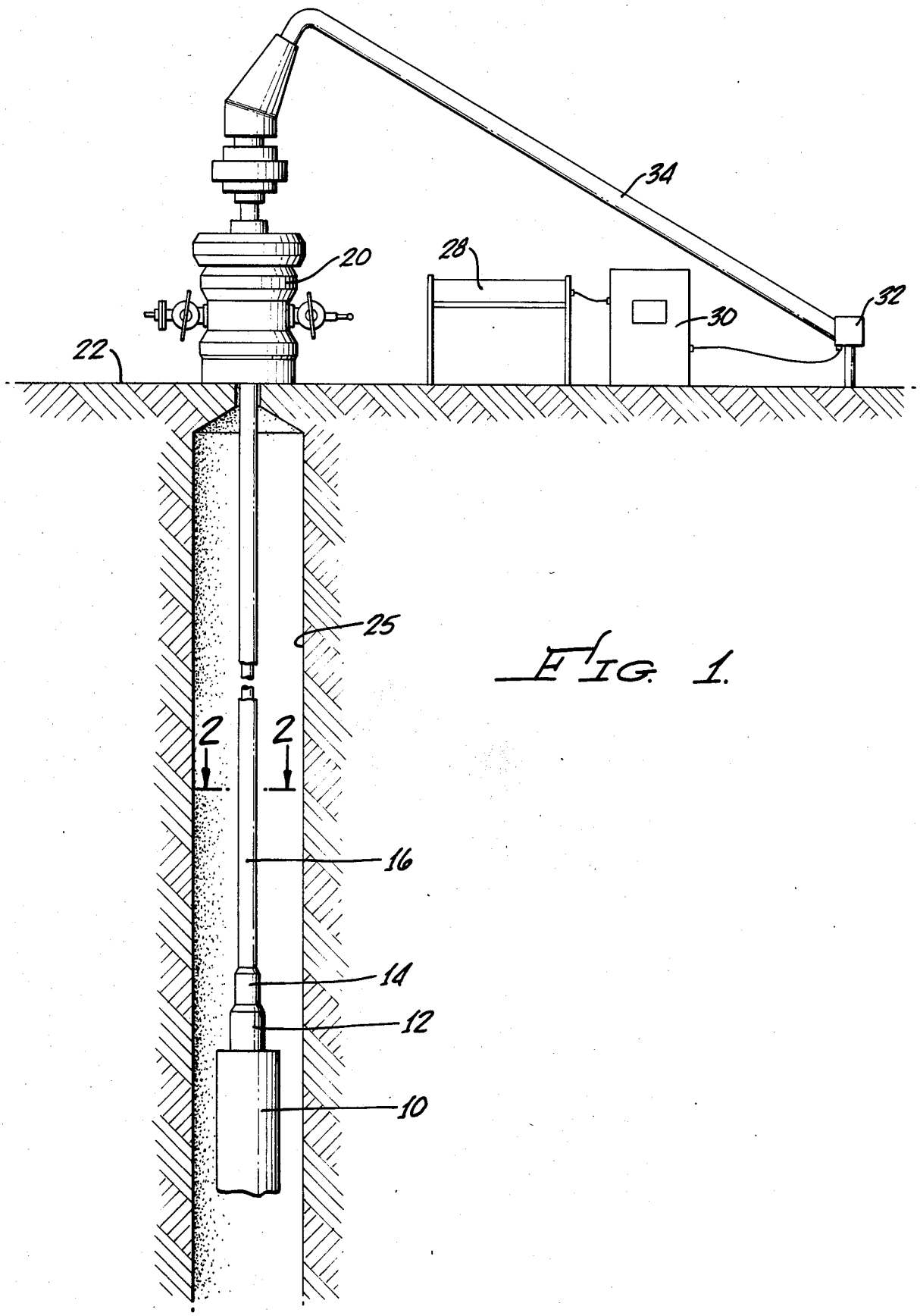
FIG. 1 is a side elevational view of a submersible pump system utilizing the flexible tubing cable system according to the invention.

Referring now to the drawings, and particularly to FIG. 1, there is shown a submersible pump system of the type used for extracting oil or other fluids from a subterranean reservoir. The system includes apparatus for use with standard submersible pumping units in known downhole (i.e., petroleum, thermal, steam, water or the like) production facilities. The system includes the electric motor 10 of the pumping unit, the motor 10 being supported at the head end thereof by a swage nipple 12, with a reducing nipple 14 secured thereto and to one end of the flexible tubing cable 16. The other end of the flexible tubing cable 16, which, in this case is of high tensile strength for supporting the pumping unit, is coupled to the well head 20 at the surface 22, the well head 20 being adapted for controlling the flow of liquid from the well therethrough. The motor 10 and cable 16 assembly are suspended within a casing 25 through which the fluid is withdrawn into the well head 20.

Above the surface the normal power and fluid distribution systems are located, the power system including an electrical transformer 28, a motor starter 30, a junction box 32 and a conduit 34 containg therein the power cable for ultimate connection to the motor 10 through the cable 16 of the invention.

Referring now to FIG. 2, there is shown an enlarged cross-sectional view of the cable 16, and as can be seen in this embodiment there is a central conductive member 40, surrounded by first and second layers of dielectric material 42 and 44, respectively, with a large area of dielectric material 46 and an outer sheath 48, concentric to the inner conductor 40.

In environments such as pumping of oils or other fluids, the environment may include known oil well corrosive elements such as known volatile gases consisting of combined sulphur chlorides, which under heat and pressure will accelerate corrosion. In thermal, geothermal and steam wells, additional parameters must be taken into consideration. Furthermore, in deep well applications, it is preferable that the motor 10 operate at high voltages, such as up to 5,000 volts in order to provide the maximum pumping capacity in a small diameter motor, thus imposing severe electrical requirements on the cable assembly to preclude dielectric breakdown.

In a first embodiment, as more particularly shown in FIG. 2, the conductor 40 is an uncoated copper conductor of diameter sufficient for conduction of the current required for normal operation of the motor 10. The first layer 42 of dielectric material is a polyimide film with a high dielectric strength, one such material being provided under the trademark of "Kapton", this layer being fused directly over the conductor 40. Such polyimide materials have a dielectric strength of approximately 7,000 volts per mil of thickness. The next layer 44 surrounds the first layer 42, with the second layer 44 being formed of a high temperature insulating glass fiber material to withstand temperatures of about 600 degrees Fahrenheit, this layer being extruded over the first layer 42. Extruded over both layers 42 and 44 is a thicker layer 46 of high temperature synthetic rubber-like compound of 600 degrees F. resistance, with the assembly being inserted into a flexible outer tubing sheath 48.

By the mold/extrusion of the layers 42, 44 and 46 over the conductor 40, the cable 16 is protected with insulation materials that are totally sealed, thereby rendering the cable 16 impervious to the gaseous fluids, hydrochloric type acids and relatively high temperature environments. With this construction, the cable 16 has high load capabilities to preclude premature service failures, known to heretofore plague the oil/water/gas production industry, and requires little or no maintenance during use.

Figure 2A:
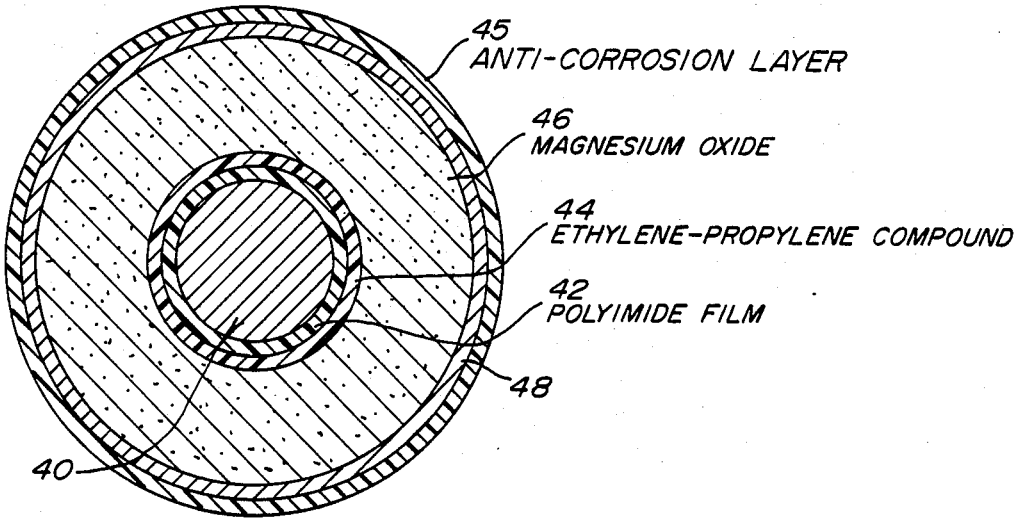
FIG. 2A is a cross-sectional view of an alternate embodiment of the flexible tubing cable of FIG. 2.

In a second embodiment, as shown in FIG. 2A, in the alternative, the first layer 42 may be a polyimide film fused or extruded directly onto the solid flexible conductor 40, with the second layer 44 being formed of a high temperature ethylene propylene composition of about 600 degrees F. tolerance, with the layer 46 being formed of a magnesium oxide compound with all three layers resulting in a cable 16 which will withstand about 1,000 degrees F. The layer 44 and the magnesium oxide layer 46 are both fused or extruded to provide maximum imperviousness to gases and the like.

In either the first or second embodiments, the outer flexible metallic tubing sheath 48 may be formed of a high tensile strength or a lower tensile strength material, depending in part on the weight to be supported by the cable 16. As shown, with the cable 16 including the outer sheath 48 for primary support of the weight of the motor 10, and with the conductor 40 positioned within this sheath 48, with the intervening layers 42, 44 and 46, the exposure of surface area of the cable 16 to the surrounding area within the casing 25 is minimized, in contrast to the prior art in which a power cable is separate and alongside the supporting cable, and subsequently the power cable is subject to mechanical abrasion.

When used in a conventional submersible pump system configuration, whereby the flexible tubing 48 is lowered alongside the production tubing, and does not support the weight of the motor 10, the outer flexible metallic tubing sheathing 48 may be formed of a lower tensile strength.

FIGS. 3 and 4 illustrate still other embodiments in which multiple conductors are employed and encased with an outer flexible metallic sheath. The cables 50 and 70 depicted in these figures each have three conductors with the cable 50 having an ovate configuration and cable 70 having a circular cross-section. By way of example the cable 50 has three conductors 51, 52 and 53, with each of the cnductors having first and second layers of dielectric material fused thereon or extruded thereover. Conductor 50 includes layers 54 and 55, conductor 52 has layers 56 and 57, and conductor 53 has layers 57 and 59. The first layers 54, 56 and 58 are preferably polyimide film or "Kapton" material with the second layers 55, 57 and 59 being a high heat moisture resistant thermosetting ethylene propylene material.

The conductors 51, 52 and 53 are preferably solid uncoated coppr and are generally spaced in generally parallel relation within the outer sheath 60 of high tensile strength flexible steel tubing with a magnesium oxide insulation compound 62 filling the volume between the conductors and the interior of the sheath 60.

In the cable 70 of FIG. 4, there are three conductors 71, 72 and 73, preferably of copper and arranged in proximate relation as a concatenated bundle, that is a twisted set, with each conductor having first and second layers of dielectric material, conductor 71 having first and second layers 74 and 75, conductor 72 having first and second layers 76 and 77, and conductor 73 having first and second layers 78 and 79, the first layers being formed of a polyimide material with the second layers being formed of a high heat ethylene propylene compound. The outer sheath 80 is formed of tubing of generally flexible high tensile strength, and an intermediate dielectric 82 of magnesium oxide fills the remaining volume.

In the cables 50 and 70, the copper conductors are soft and uncoated, and may be, for example, #6 AWG, #4 AWG and #2 AWG, each being provided with the first layer fused directly over the conductor, with the polyimide film being virtually unaffected by most chemicals. Extruded directly over this first layer is the second layer of ethylene propylene compund which is a high heat moisture resistant thermosetting compound.

The magnesium oxide insulation 62 and 82 of cables 50 and 70, respectively, is compressed over the so-layered conductors, and provides insulation ideally suited to withstand over 1,000 degrees F. temperatures and heavy current overloads, and furthermore, the magnesium oxide insulation in conjunction with the ethylene propylene compound provides an explosion proof cable 50 or 70 which does not provide a path for migration of gases, vapors or any type of chemicals.

Furthermore due to the utilization of inorganic compounds in the dielectric material selection, such cables withstand extremely high temperatures and provide excellent overload protection. Such cables will not become brittle at very low temperatures regardless of the length of time exposed to the atmosphere. The flexible outer sheaths 60 and 80 of cables 50 and 70, respectively, provide protection from mechanical damage, as well as protection from the well fluids, such as gas, corrosive fluids, acid compounds and other chemicals normally found in downhole production facilities. In addition, due to the construction of cables 50 and 70, such cables provide structural strength on the exterior of the assembly to facilitate running and retrieving of the submersible pumps.

Figure 2B:
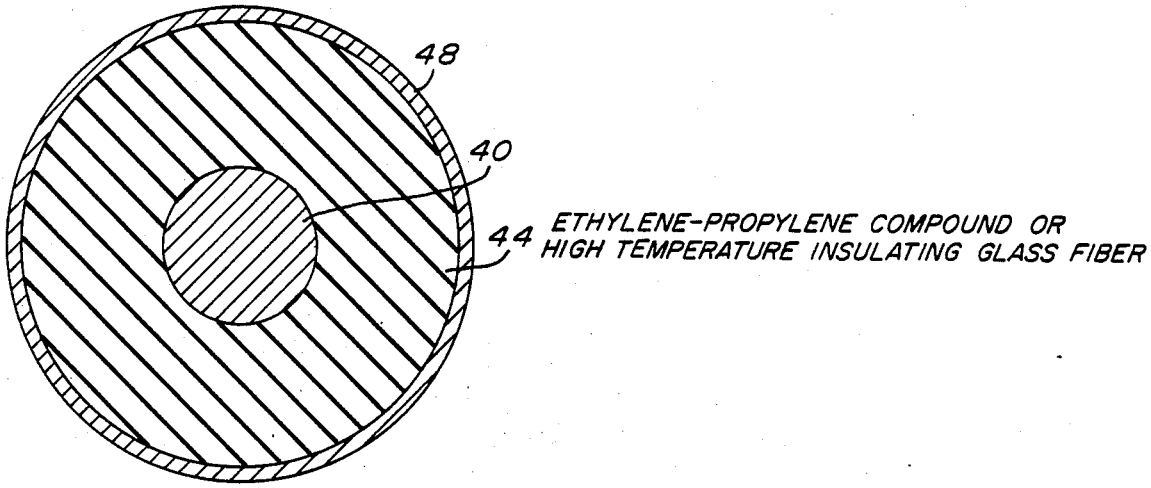
FIG. 2B is a cross-sectional view of still another embodiment of the flexible tubing cable of FIG. 2.
Figure 2C:
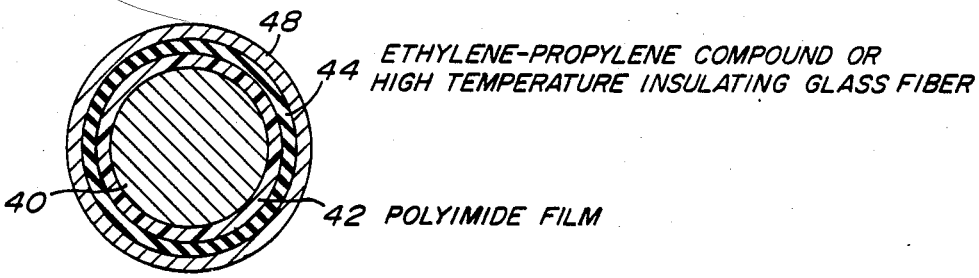
FIG. 2C is a cross-sectional view of yet another embodiment of the flexible tubing cable of FIG. 2.

In a third embodiment, as shown in FIG. 2B, in the alternative, for certain applications as outlined herein, the cable could consist of conductor 40, the second layer 44, and the flexible outer sheath 48. As outlined above, layer 44 could be either one of a high temperature insulating glass fiber material or an ethylene propylene compound. As another embodiment, as shown in FIG. 2C, the cable 16 could be comprised of core 40, layers 42 and 44, and outer sheath 48. In this embodiment, as mentioned above, layer 42 could be a dielectric polyimide film.

In any of the above described embodiments the outer flexible sheath 48, could be coated with an anti-corrosion layer (as shown by way of example at 45 in FIG. 2) depending upon the environment in which the cable is used.

While there have been shown and described preferred embodiments, it is to be understood that various adaptations may be made within the spirit and scope of the invention.

I claim:

1. In a cable system for use with pumping means in submersible below ground applications for both supporting the pumping means and for providing electrical power thereto, the combination comprising:

at least one conductor member for providing electrical power to a pumping means;

a first dielectric layer of polyimide film on said conductor member;

a second dielectric layer on said first dielectric layer, said second dielectric layer being formed of an ethylene propylene compound;

a flexible metallic continuous tubular member of generally high tensile strength configured for receiving said at least one conductor member therein in generally spaced relation relative to the inner walls of said tubular member, said tubular member having sufficient strength for supporting therefrom a suspended submersible pumping means; and a third dielectric layer of magnesium oxide intermediate said second dielectric layer and the inner walls of said tubular member.

2. The combination according to claim 1 wherein said first dielectric layer is fused on said conductor member.

3. The combination according to claim 1 wherein said system includes at least two conductor members with each having the same dielectric for said first layers, and the same dielectric for said second layers.

4. The combination according to claim 1 wherein said tubular member has an ovate cross-section.

5. The combination according to claim 1 wherein said tubular member is generally circular in cross-section and said system includes three first and second layered conductor members, and said conductor members are concatenated and disposed generally centrally relative to said tubular member.

6. The combination according to claim 1 further including an anti-corrosion layer of material over said flexible metallic tubular member.

7. In a cable system for use with pumping means in submmersible below ground applications for both supporting the pumping means and for providing electrical power thereto, the combination comprising:

at least one conductor member for providing electrical power to a pumping means;

a first dielectric layer of polyimide film on said conductor member;

a second dielectric layer of high temperature insulating glass fiber material on said first dielectric layer;

a flexible metallic continuous tubular member of generally high tensile strength configured for receiving said at least one conductor member therein in generally spaced relation relative to the inner walls of said tubular member, said tubular member having sufficient strength for supporting therefrom a suspended submersible pumping means; and a third dielectric layer of synthetic rubber material intermediate said second dielectric layer and the inner walls of said tubular member.

8. The combination according to claim 7 wherein said first dielectric layer is fused on said conductor member.

9. The combination according to claim 7 wherein said system includes at least two conductor members with each having the same dielectric for said first layers, and the same dielectric for said second layers.

10. The combination according to claim 7 wherein said tubular member has an ovate cross-section.

11. The combination according to claim 7 wherein said tubular member is generally circular in cross-section and said system includes three first and second layered conductor members, and said conductor members are concatenated and disposed generally centrally relative to said tubular member.

12. The combination according to claim 7 further including an anticorrosion layer of material over said flexible metallic tubular member.

* * * * *